US005746132A

United States Patent [19]

Parks et al.

[11] Patent Number: 5,746,132

[45] Date of Patent: May 5, 1998

[54] VARIABLE REPEAT PLATE AND BLANKET CYLINDER MECHANISM

[75] Inventors: Thomas Dewayne Parks, Tacoma; Michael Rolland Turner, Renton, both of Wash.; Dale Leon Bunnell, Chesterfield; Gary Wilson Teeter, St. Louis, both of Mo.

[73] Assignee: Mark Andy, Inc., Saint Louis, Mo.

[21] Appl. No.: 710,138

[22] Filed: Sep. 24, 1996

[51] Int. Cl.[6] ..... B41F 13/24

[52] U.S. Cl. ..... 101/483; 101/247; 101/218

[58] Field of Search ..... 101/179, 220, 101/216, 247, 248, 182, 184, 185, 192, 218, 219, 483

[56] References Cited

U.S. PATENT DOCUMENTS

| | | | |
|---|---|---|---|
| 3,057,292 | 10/1962 | Larsen | 101/247 |
| 3,099,956 | 8/1963 | Anderson et al. | 101/247 |
| 3,196,786 | 7/1965 | Hornberger et al. | 101/247 |
| 3,616,751 | 11/1971 | Mowry | 101/220 |
| 4,290,361 | 9/1981 | Fowler et al. | 101/182 |
| 4,369,705 | 1/1983 | Gelinas | 101/247 |
| 4,458,591 | 7/1984 | Guaraldi | 101/247 |
| 5,337,664 | 8/1994 | Hannon | 101/218 |
| 5,351,616 | 10/1994 | Gelinas | 101/218 |
| 5,445,076 | 8/1995 | Sugiyama | 101/218 |
| 5,461,978 | 10/1995 | Chou | 101/248 |
| 5,546,860 | 8/1996 | Riis | 101/247 |
| 5,588,362 | 12/1996 | Sugiyama et al. | 101/218 |

*Primary Examiner*—Eugene H. Eickholt
*Attorney, Agent, or Firm*—Foley & Lardner

[57] ABSTRACT

A printing machine designed to accommodate different repeat lengths for a first and second cylinders, that includes: a front and rear frames; a first cylinder cartridge, including a first cylinder with a centerline; a first assembly attached to the front and rear frames for holding the first cylinder cartridge; a second cylinder cartridge separate from the first cylinder cartridge, with the second cylinder cartridge including a second cylinder with a centerline; a first and second cradles for holding the ends of the second cylinder cartridge, with the cradles including a cradle arm with an opening therein; and a second assembly for each cradle for moving its respective cradle to hold different diameter second cylinders in parallel adjacency with the first cylinder. The second assembly is specifically designed to be operable to change the orientation of its respective cradle for each different diameter second cylinder to facilitate lift-off. In a preferred embodiment, this change in orientation is performed during the movement of the cradle that brings the second cylinder into parallel adjacency with the first cylinder. It is also preferred that the orientation of the cradles be such that the line between the centerlines for the first and second cylinders very approximately straddles the opening of the cradle arm.

36 Claims, 11 Drawing Sheets

VARIABLE REPEAT PLATE AND BLANKET CYLINDER MECHANISM

BACKGROUND OF THE INVENTION

The present invention relates generally to printing presses, and more particularly to a printing press design that facilitates changing repeat lengths over a range of diameters while, at the same time, facilitating lift-off.

Changing the repeat length for a printer requires changing the diameter of one or more of the cylinders in the press. This is a difficult and time-consuming process. Moreover, changing cylinder diameters will, in many cases, change the orientation of the cylinders, making the lift-off process difficult, and, in some cases, ineffective. Lift-off is the process of lifting one of the cylinders by a very slight amount away from the web or paper, when the press is stopped, in order to prevent ink smudges, while maintaining gear tooth engagement to thereby maintain rotational registry.

With reference to the offset printing industry, this industry has typically used fixed repeat plate and blanket cylinders in either "sheet feed" or "intermittent feed, web fed" presses. In order to change repeat lengths in such presses, smaller repeat plates and blankets may be mounted to the larger cylinders. In a sheet fed press, a sheet of paper of the proper length to match the repeat is fed through for each cycle. In the case of an intermittent feed web press, the press feeds only the proper length of web through during each cycle, then stops and waits for the next cycle to begin. Both methods are typically very slow.

The only other method known for varying repeat lengths in an offset press is by using what is commonly referred to as the "cartridge" approach. This approach can be used in a continuous web fed press and is typically much faster than the other methods. The plate and blanket cylinders of a given repeat length are mounted into a common cartridge and the cartridge is installed into the printing head. When a different repeat length is required, the entire cartridge is removed and a different set of cylinders installed thereon or, depending on the repeat length change, the cartridge itself is changed to allow a larger or a smaller set of cylinders to be used.

The cost of one cartridge containing both cylinders is approximately $12,000, depending on the size of the press, and the repeat range desired. Due to this expense, suppliers of such equipment usually recommend to their customers that they determine up to three repeat sizes that will cover all of their printing requirements. This recommendation is made in order to reduce the initial expense to the customer by only requiring the purchase of three cartridges for each print head.

Cartridges are typically quite large and heavy, requiring a cart to remove them from the press, and to transport them to a storage area that must be able to store all of the various cartridges. A typical six-color press would have 18 cartridges or more, in order to facilitate a range of different repeat lengths. From the above, it can be seen that the expense and difficulty in changing repeat lengths in a printer is a significant impediment to the industry.

OBJECTS OF THE INVENTION

Accordingly, it is an object of the present invention to facilitate the use of different diameter printing press cylinders.

It is a further object of the present invention to facilitate lift-off over a range of cylinder diameters and cylinder orientations.

It is a yet further object of the present invention to facilitate the removal of blanket and plate cylinders independently of each other.

It is yet a further object of the present invention to facilitate the use of low cost, light-weight plate and blanket cylinders over a full range of diameters.

SUMMARY OF THE INVENTION

Briefly, the present invention is designed to facilitate the different cylinders in a printing press being removed independently of each other and replaced with different diameter cylinders. Accordingly, the present invention comprises a printing machine designed to accommodate different repeat lengths for a first cylinder and a second cylinder therein, including: a front and rear frames; a first cylinder cartridge, including a first cylinder with a centerline; a first assembly attached to the front and rear frames for holding the first cylinder cartridge; a second cylinder cartridge separate from the first cylinder cartridge, with the second cylinder cartridge including a second cylinder with a centerline; a first and second cradles for holding ends of the second cylinder cartridge, with the cradles including a cradle with an opening therein; and a second assembly for each cradle for moving its respective cradle to hold different diameter second cylinders in parallel adjacency with the first cylinder, with the second assembly operable to change the orientation of its respective cradle for each different diameter second cylinder.

In one embodiment, structure is included to change the orientation of the respective cradle during movement of the cradle to bring the second cylinder in parallel adjacency with the first cylinder, so that the cradle is always properly oriented.

In a further embodiment, the second assembly may include means for moving the cradle arms through a range of orientations so that a line connecting the centerlines for the first and second cylinders is within plus or minus 30° of a line that straddles the opening of the cradle arm. In a preferred embodiment, the line is within plus or minus 10° of the line that straddles the opening of the cradle arm.

In a further embodiment of the present invention, the second assembly may comprise a sub-plate on which the cradle is mounted, with the sub-plate being movable through a prescribed range of orientations to facilitate lift-off.

In a further refinement of this embodiment, an oriented slot may be formed in each of the frames, and a set of rollers may be mounted on the sub-plate, with the sub-plate being positioned so that the rollers ride in the slot with the slot being oriented so that when the sub-plate is moved, its orientation is changed as the rollers ride in the slot.

In a further refinement of this configuration, the cradle may comprise a bottom cradle arm, and a top cradle arm positioned thereover that may be moved to open the cradle to permit the positioning of an end of the second cylinder therein.

In yet a further embodiment of the present invention, the second assembly may include an adjusting arm connected to the sub-plate, and an actuator connected to the adjusting arm and operable, when actuated, to cause the adjusting arm to move in a prescribed path to thereby cause the sub-plate to move, thereby moving the second cylinder and, at the same time, adjusting the orientation of the cradle arms.

In a further refinement of this configuration, the second assembly may comprise a clamping mechanism for clamping the adjusting arm in a stationary position. In a yet further embodiment of the present invention, the sub-plate in the second assembly may be disposed on the interior side of one of the frames and its respective adjusting arm being disposed on the exterior side of the one of the frames, with the sub-plate being connected to its respective adjusting arm by means of a hub which extends through an opening in the frame.

In a further embodiment of the present invention, the first assembly may include means for laterally moving the first cylinder so that it is in line with the printing plates on other first cylinders in other print stations.

In yet a further embodiment, a shaft may be included on which the adjusting arms pivot, with the shaft extending through the front and rear frames in parallel with the first and second cylinder cartridges. The second assembly may further comprise an actuator for causing a lift-off of the second cylinder.

The present invention further comprises a method to permit different repeat lengths for a first cylinder and a second cylinder, comprising the steps of: placing a first cylinder cartridge which includes a first cylinder in a first assembly; placing ends of a second cylinder cartridge which includes a second cylinder in a set of first and second cradles so that the second cylinder is parallel to the first cylinder. The method further comprises the step of moving the cradles to thereby move the second cylinder in close parallel adjacency to the first cylinder, and the step of changing the orientation of its respective cradle for different diameter cylinders to facilitate lift-off of the second cylinder.

In a further embodiment, the method may include the step of changing the orientation of the cradles during the cradle moving step so that the cradle is always properly oriented for lift-off.

In a yet further embodiment of the method, the orientation changing step may comprise the step of changing the orientation of the cradles so that a line connecting the centerlines of the first and second cylinders is within plus or minus 30° of a line that straddles the opening of the cradle.

In a further embodiment of this method, the moving step may comprise the step of moving an adjusting arm, that is connected by way of a sub-plate to the cradles, so that the adjusting arm pivots to cause the second cylinder to move, with the movement of the sub-plate operating to adjust the orientation of the cradle.

DETAILED DESCRIPTION OF THE PREFERRED EMBODIMENTS

The present invention is based on the concept of making the first and second cylinders in a machine, removable independently of each other, to thereby facilitate diameter repeat length changes, while at the same time, avoiding the use of large and expensive multi-cylinder cartridges. This design is particularly advantageous in the printing press industry because it permits the use of economical light-weight plate and blanket cylinders, so that a customer can afford to purchase a large number of different blanket and plate cylinders covering a range of diameters for each print head.

A particular problem that occurs when the plate and blanket cylinders are removable independently of each other is that they will be in different orientations relative to one another, depending on their diameters. This change in cylinder orientation as the diameters for the blanket cylinder and the plate cylinder change, causes significant impediments to a uniform lift-off procedure. Lift-off is the procedure wherein the blanket cylinder is lifted off and away from the web or paper by a small distance to prevent smudging when the press is stopped. The normal requirement for lift-off is that the blanket roll be lifted away from the paper by a small amount, while at the same time maintaining contact with the plate cylinder so that ink may continue to be transferred between the blanket cylinder and the plate cylinder. Accordingly, gear tooth engagement between the blanket cylinder and the plate cylinder is maintained so that rotational registry is also maintained.

Figure 1:
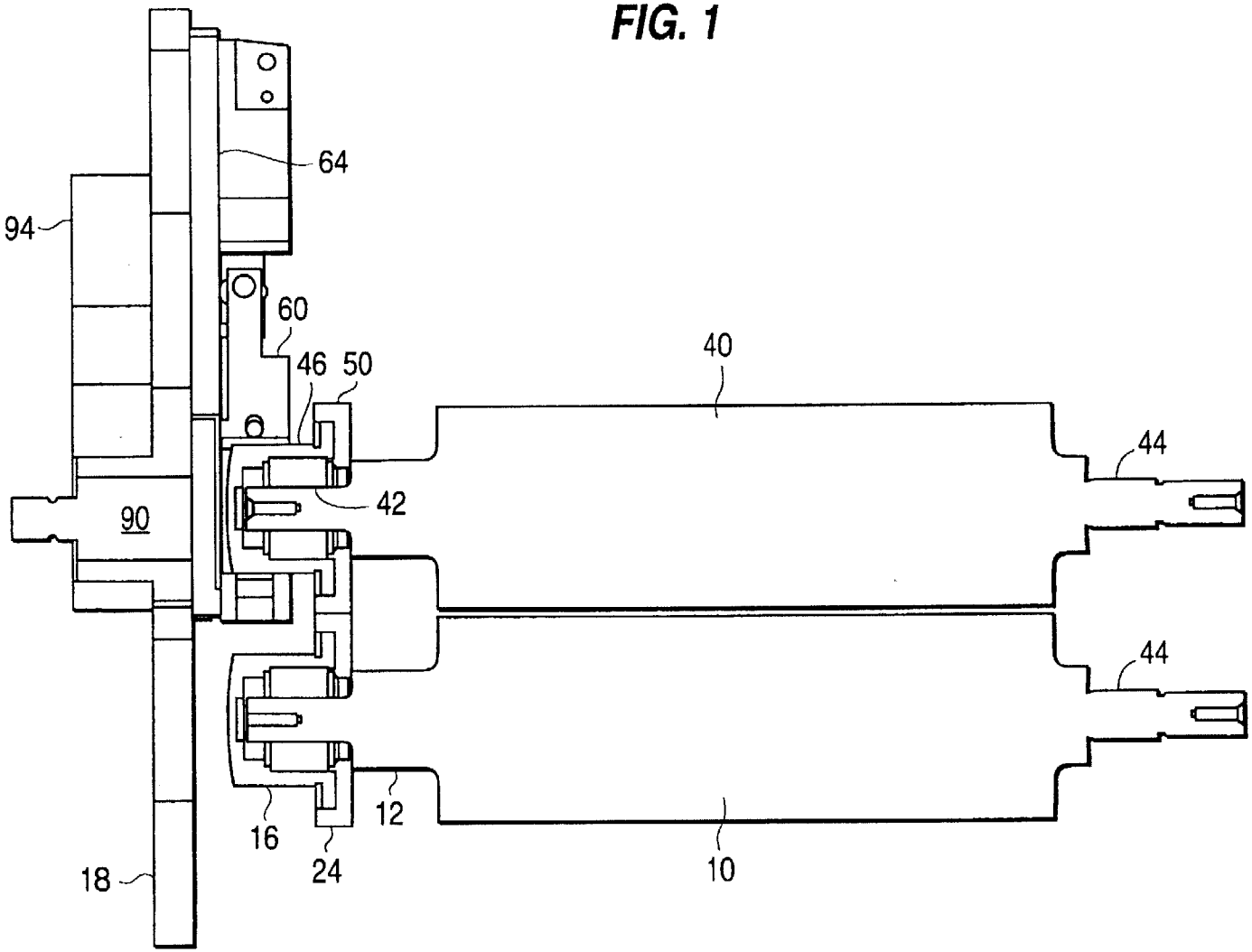
FIG. 1 is a schematic side view of one embodiment of the present invention.
Figure 2:
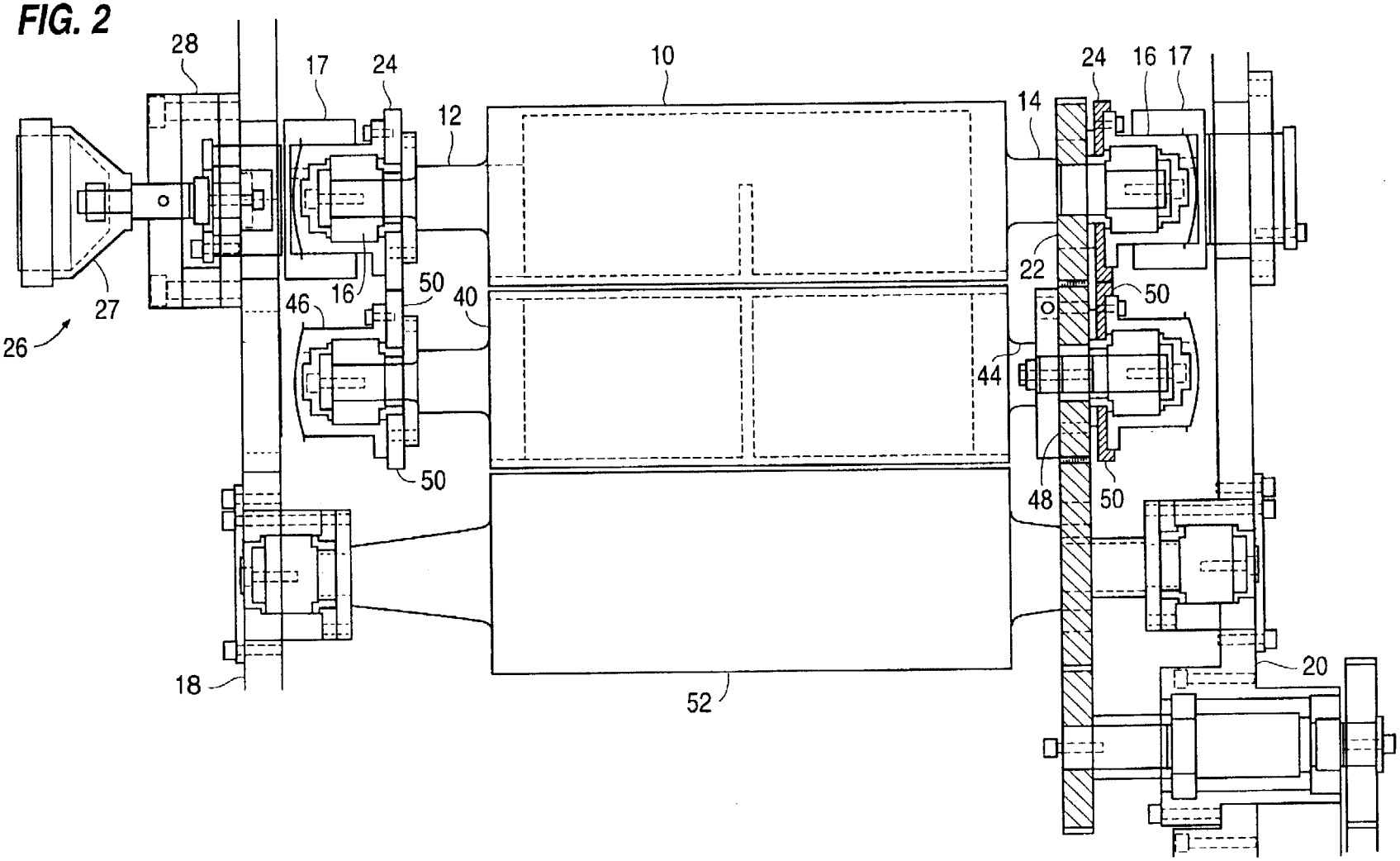
FIG. 2 is a schematic side view illustrating additional features of FIG. 1.

Referring now to FIG. 1 and FIG. 2, in combination, there is shown a plate cylinder 10 with respective ends 12 and 14, disposed in a bearing cartridge assembly 16. The bearing cartridge assembly 16 is mounted in a sliding cartridge 17. The sliding cartridges 17 are mounted in a well-known manner to frames 18 and 20. The plate cylinder 10 is driven by a drive gear 22. Disposed in adjacency to the bearing cartridge assembly 16 is a fixed bearer 24 at each end thereof. A side register adjust mechanism 26 is shown in FIG. 2 for moving the plate cylinder cartridge 16 laterally for some distance. This side register adjustment mechanism 26 comprises a handwheel 27 set to provide adjustable movement by means of a front eccentric cartridge 28, having different centerline than the plate cylinder 10, which operates to move the sliding cartridge 17 laterally for some distance. Note that the sliding cartridges 17 are positioned at both end 12 and 14 of the plate cylinder 10. Accordingly, when the plate cylinder 10 is "dropped-in" to the sliding cartridge 17, and clamped in place, the entire assembly will move laterally via adjustment of the hand wheel 27 to position the printing cylinder 10 in line with the other printing cylinders in other print stations. It should be noted that the cartridge 17, the hand wheel 26 and the front eccentric cartridge 28 are shown only in FIG. 2 for ease of illustration.

Note that each plate cylinder 10 will vary in diameter with each different repeat length, and the fixed bearers 24 attached at each end 12, 14, of the plate cylinder 10 provide a precision, solid stop for all adjacent cylinders to ensure that they always come into the proper contact with the printing cylinder 10 but avoid over-compression between the cylinders.

FIGS. 1 and 2 further include a blanket cylinder 40 with a blanket (not shown) disposed therearound. The blanket cylinder 40 includes ends 42 and 44 disposed in a bearing cartridge assembly 46. The blanket cylinder 40 may be driven by an adjustable drive gear 48. The gear 48 is made adjustable to allow it to be rotated a few degrees to permit the gap for the blanket on the blanket cylinder 40 and the gap for the plate on the plate cylinder 10 to be aligned. The blanket cylinder gear 48 will be used to drive the plate cylinder gear 22 to thereby drive or rotate the blanket cylinder 10, and to also provide a means to drive the inking system. The blanket cylinder ends 42 and 44 also include bearers 50 disposed thereon to set the distance between the plate cylinder and the blanket cylinder to prevent overcompression. Note that the bearers 24 and 50 and the cartridges 16 and 46 may be given a similar or identical configuration for ease of manufacturing. FIG. 2 also shows an impression cylinder 52 disposed between the frames 18 and 20. The impression cylinder 52 provides support to the web as ink is being put on by the blanket cylinder. In essence, the impression cylinder 52 supports the back surface of the web as it is under impression from the blanket cylinder 40.

Note that the plate cylinder 10 and the plate cylinder bearing cartridge 16 may be viewed as comprising a first cylinder cartridge, while the blanket cylinder 40 and the blanket cylinder bearing cartridge assembly 46 may be viewed as comprising a second cylinder cartridge.

Figure 3:
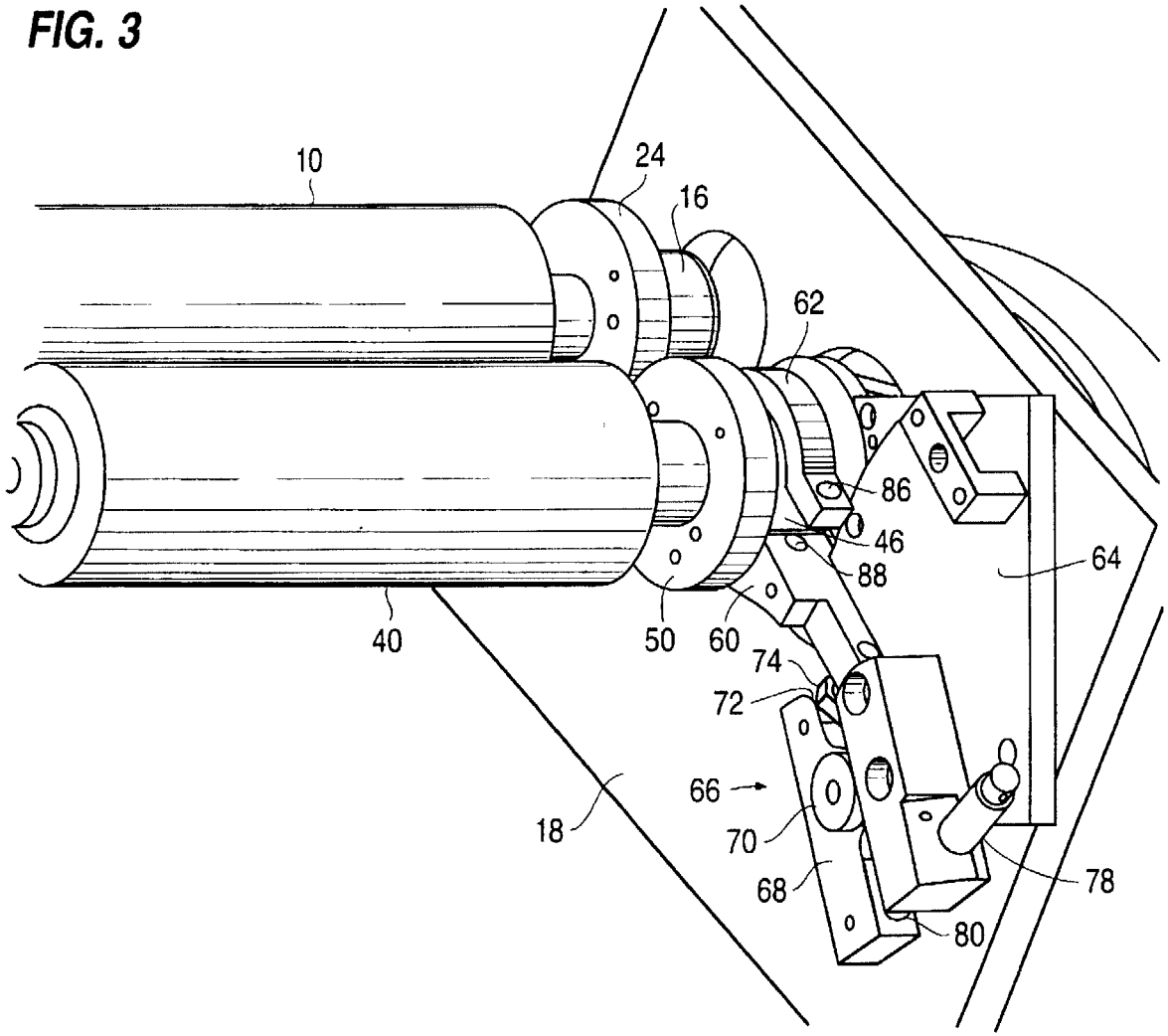
FIG. 3 is a fixed perspective view of one embodiment of the present invention.
Figure 4:
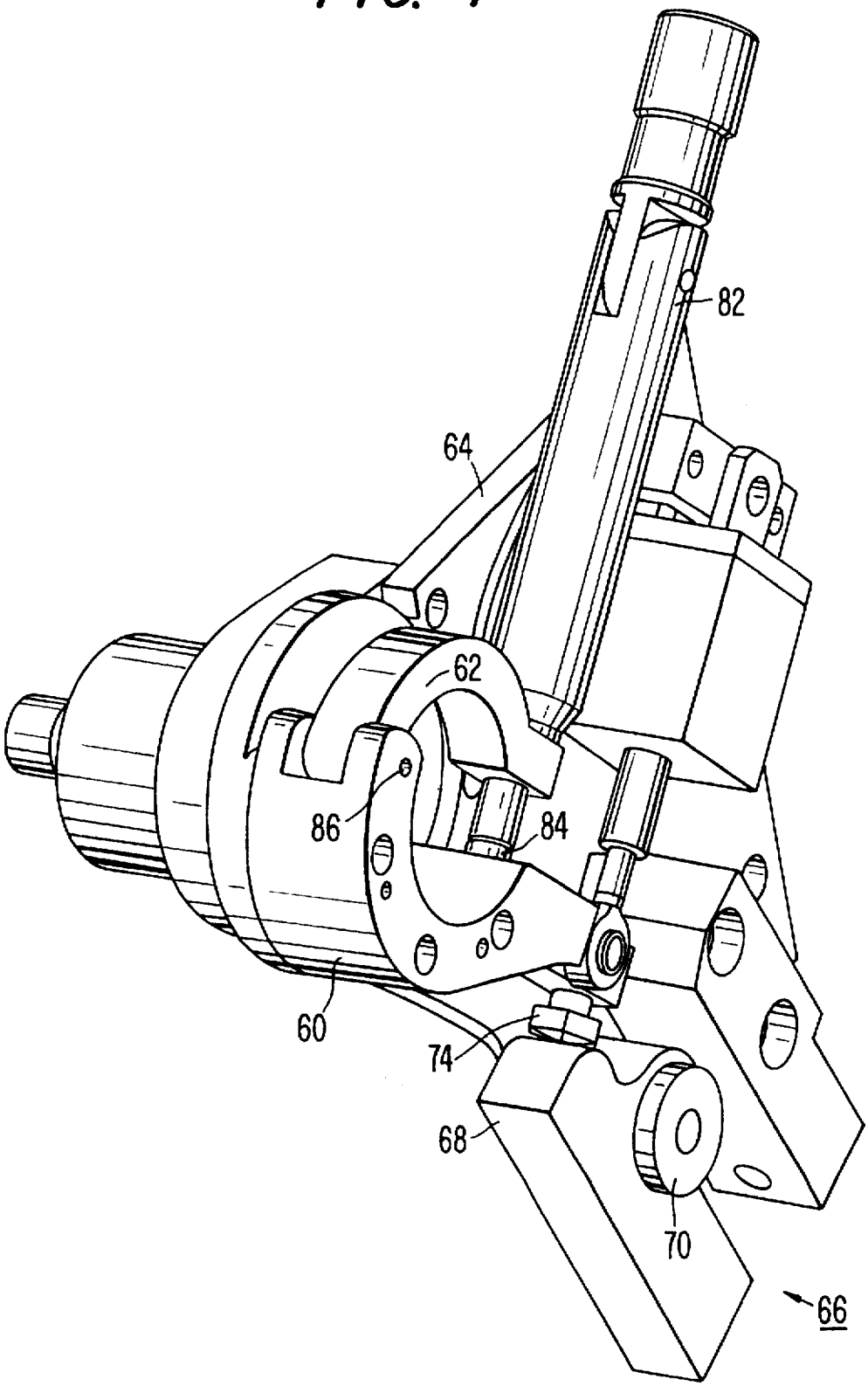
FIG. 4 is a further perspective view of the embodiment shown in FIG. 3.

Referring now to FIGS. 3 and 4, the bearing cartridge assembly 46 for the blanket cylinder 40 is shown resting in a set of cradle arms 60 and 62. The cradle arms 60 and 62 are in-turn, mounted on a sub-plate 64. Note that there is a separate set of cradle arms 60 and 62 mounted on a sub-plate 64 for each of ends 42 and 44 of the blanket cylinder 40. The sub-plates 64 are mounted inside the front and rear frames 18 and 20. The cradle arms 60 and 62 provide the throw-off/on action for the blanket cylinder 40, which operation will be described in detail below. The configuration further includes an adjustable stop 66 provided to adjust for fine positioning of the blanket cylinder 40 relative to the impression cylinder 52 to allow for various web thicknesses or calipers. The adjustable stop 66 comprises a stop block 68 which pivots on a pivot shaft 70. The adjustable stop block 68 has a surface 72 in contact with a surface 74 of the cradle arm 60. In the configuration shown in FIG. 3, the surface 74 for the cradle arm 60 comprises a bolt 74. Adjustment of the adjustable stop 66 is achieved by means of a handwheel 76 (shown in FIG. 5) that is mounted to a threaded shaft 78. The end of the threaded shaft 78 comes in contact with the stop block 68 at the surface 80. The handwheel 76 may have "position indication" indicia disposed thereon to allow fine adjustment to be performed using a chart that indicates that a certain number on a dial represents the proper position for a given web caliper. In essence, the stop 68 operates to limit travel of the blanket cylinder 40 toward the impression cylinder 52. In particular, the bolt head 74 contacts the edge of the stop block 68 and limits travel of the cradle arms 60 and 62.

Referring to FIG. 4, it can be seen that the upper cradle arm 62 pivots from a pivot shaft 86 set into the frame of the lower cradle arm 60. Once the upper cradle arm 62 has been pivoted to close around the bearing cartridge assembly 46 for the blanket cylinder 40, then the upper cradle arm 62 may be secured by means of a shaft 82 with a smaller diameter shaft 84 with a threaded end. The smaller diameter end 84 may be inserted through a hole 86 (shown in FIG. 3) in the upper cradle arm 62 and threaded into a hole 88 (shown in FIG. 3) in the lower cradle arm 60.

Figure 5:
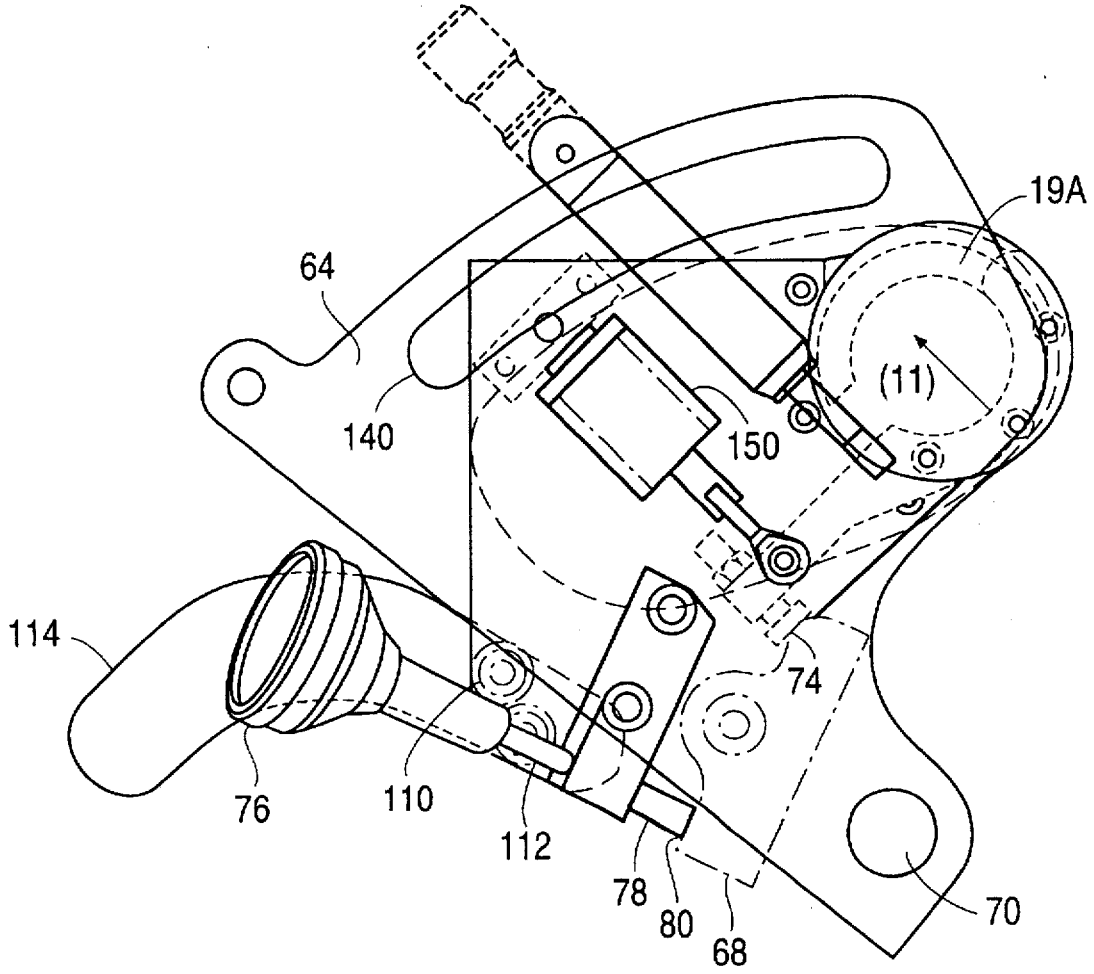
FIG. 5 is a schematic side view of a section of the printing press of the present invention.
Figure 6:
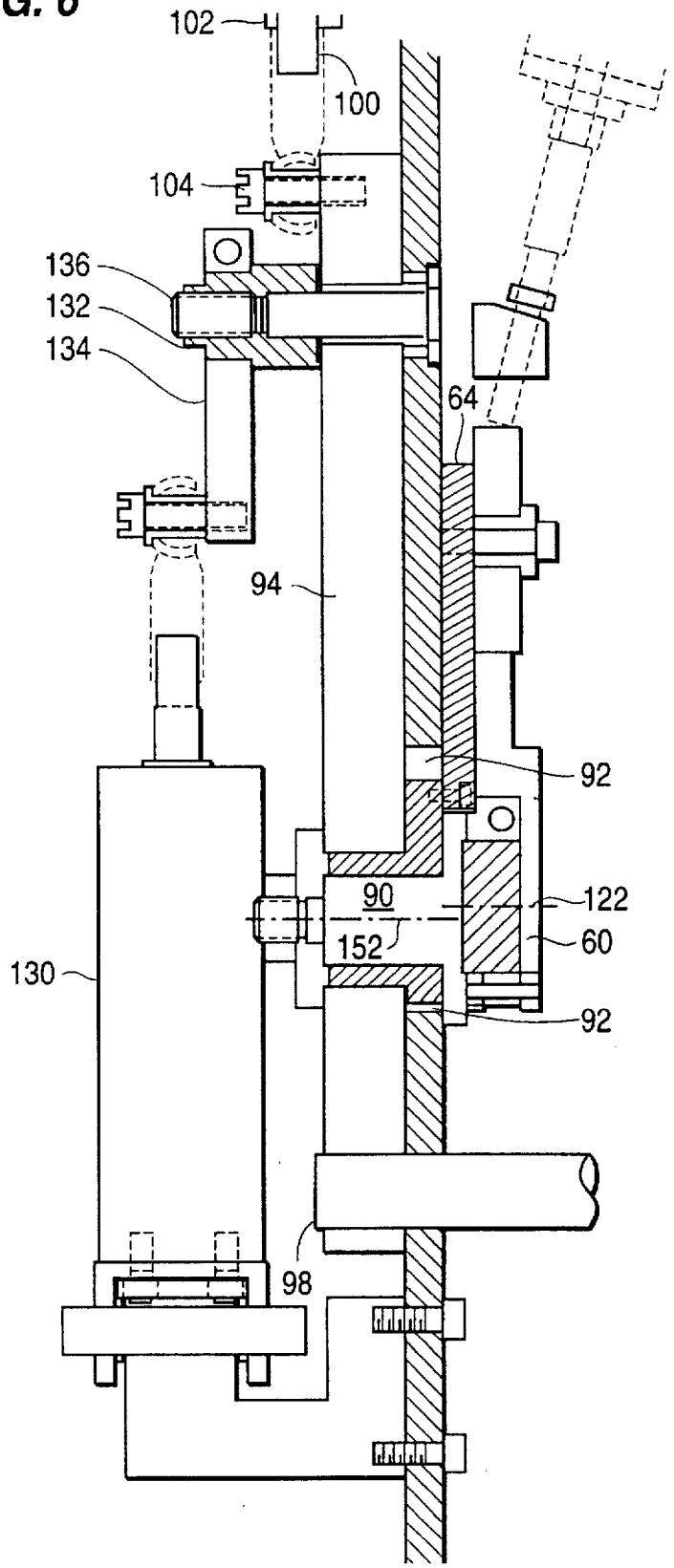
FIG. 6 is a schematic side view of a different section of the printing press of the present invention.
Figure 7:
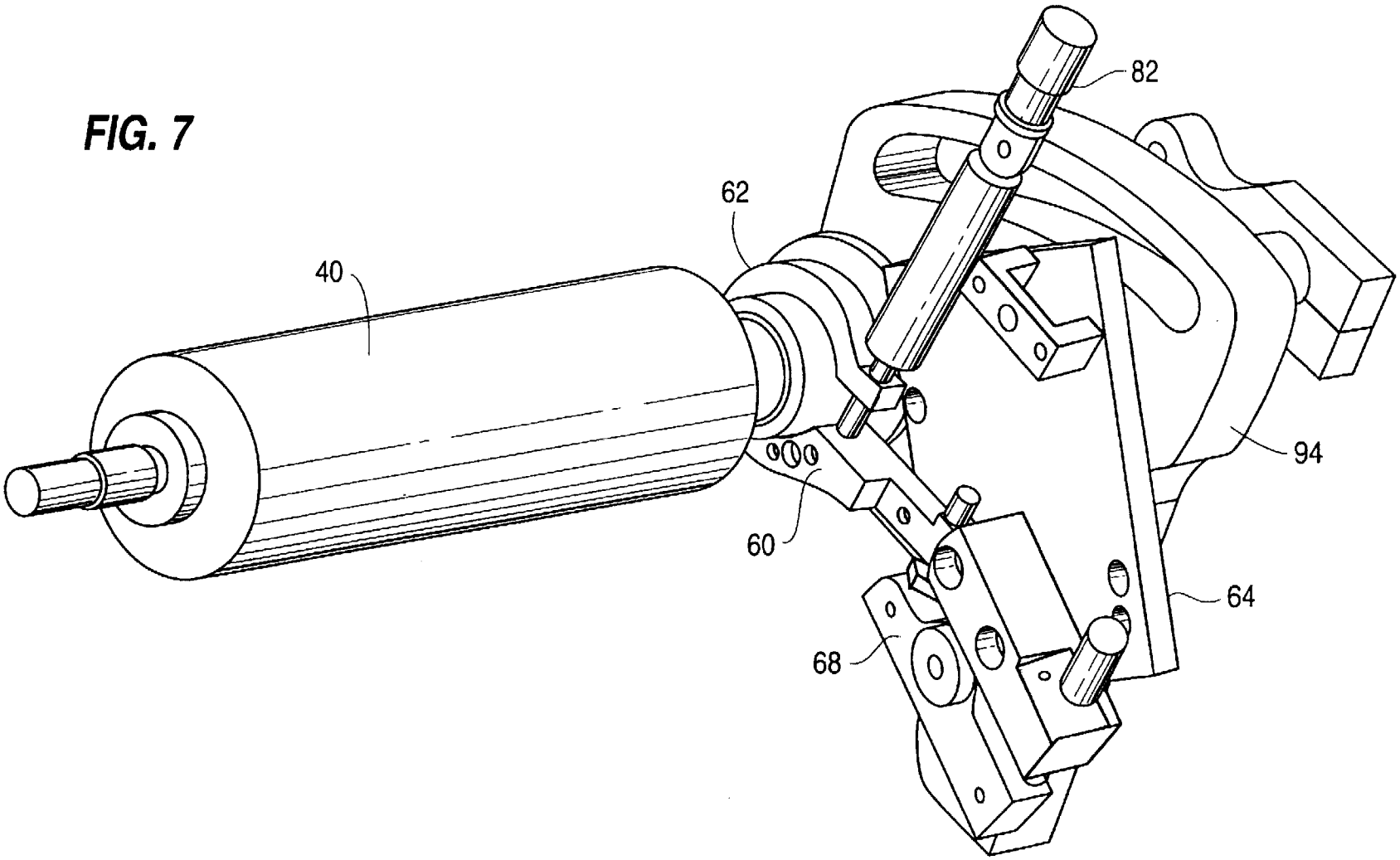
FIG. 7 is a perspective view of one portion of the printing press of the present invention.
Figure 8:
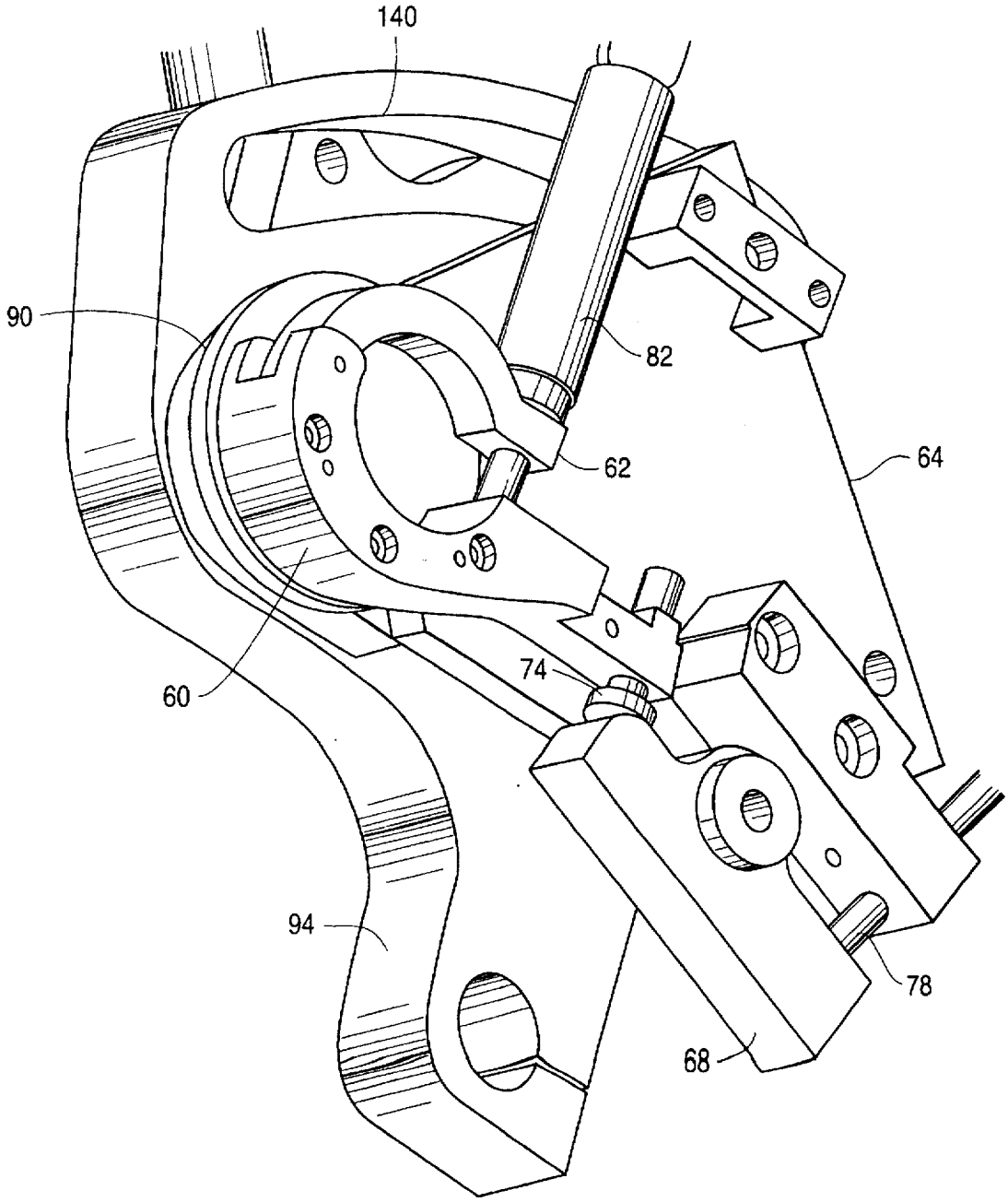
FIG. 8 is a perspective view showing the arm, cradle, and sub-plate.

FIG. 6 shows a side view of a portion of the press mechanism. FIG. 6 clarifies that the sub-plate 64 is mounted to a hub 90 that extends through a large cutout 92 in each of frames 18 and 20. The large cutout in the frames 18 and 20 is shown more clearly in FIG. 5 by the dashed lines. An adjusting arm 94 on the outside of both the front frame 18 and the rear frame 20 is mounted on the section of the hub 90 which protrudes outside of the respective frames 18 and 20.

The blanket cylinder 40 may be moved into or out of parallel adjacency relative to the plate cylinder 10 by moving the cradle arms 60 and 62. The cradle arms 60 and 62 are in turn moved by moving the adjusting arms 94 on the outside of the frames 18 and 20, which adjusting arms 94 are connected to the cradle arm 60 and 62 by means of the hub 90. There are a variety of different methods by which the adjusting arm 94 may be moved to thereby provide adjustment to the blanket cylinder 40. By way of example, but not by way of limitation, movement of the adjusting arms 94 is accomplished in FIG. 6 by pivoting the adjusting arms 94 from a common shaft 98 that extends through both the front frame 18 and the rear frame 20. The adjusting arms 94 may be moved or actuated by any standard force creating system. By way of example, the rod end 100 from an air cylinder 102 may be connected by a pivot shaft 104 to the adjusting arms 94 in order to provide an appropriate force to the adjusting arms 94.

Figure 10:
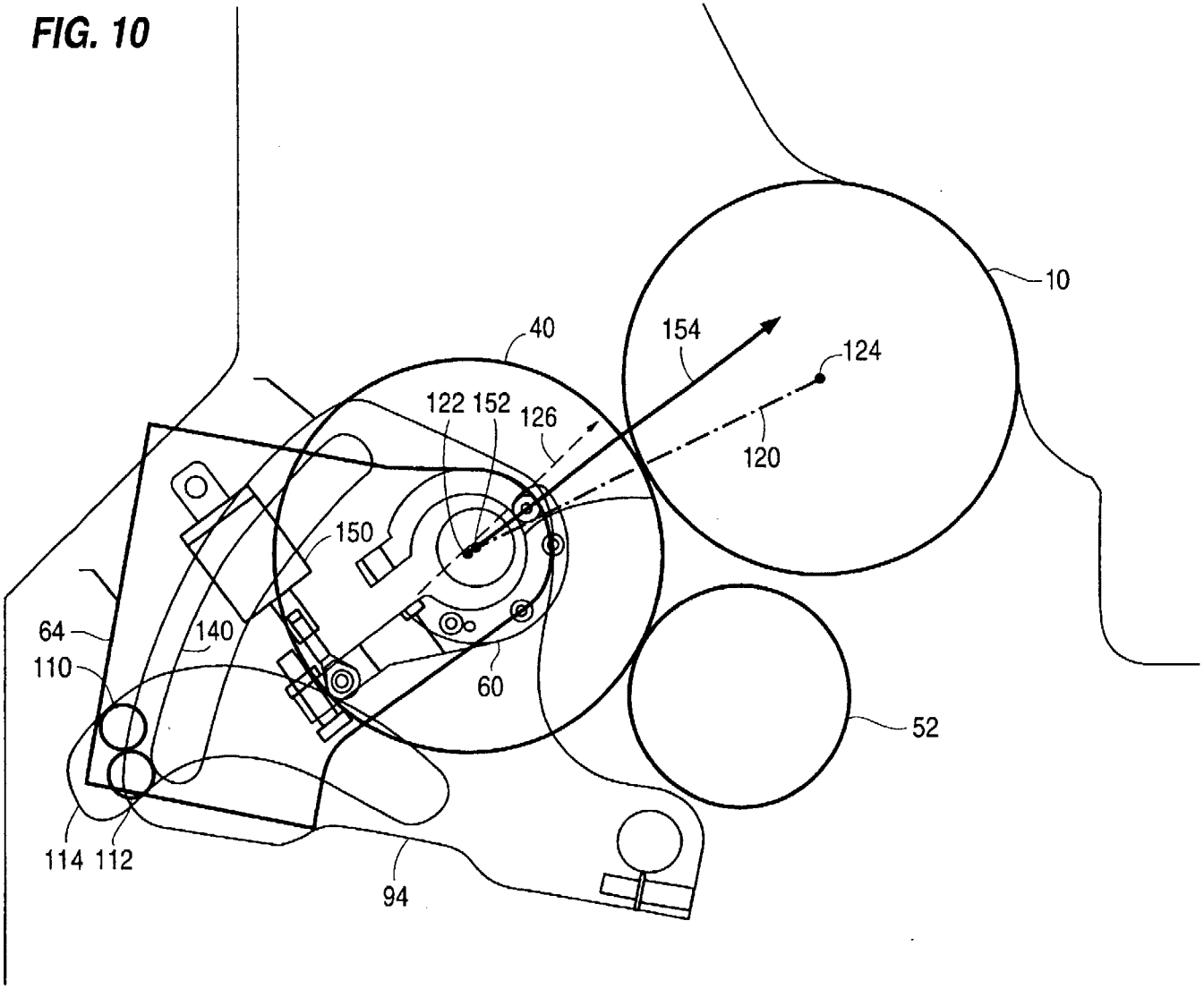
FIG. 10 is a schematic side view of the present invention with the first and second cylinders having large diameters.

As the sub-plate 64 travels through its arc from its minimum position to a maximum position, the orientation of the cradle arms 60 and 62 must be adjusted so that the blanket cylinder 40 will lift-off in the proper direction. A variety of different methods may be utilized in order to make this adjustment of the cradle arms 60 and 62. In the embodiment described for the present invention, a set of rollers 110 and 112 are mounted to the sub-plate 64 in such a manner that they ride in a machined slot 114 which is set in the frames 18 and 20. The rollers 110 and 112 and the machined slot 114 are best seen in FIG. 5, FIG. 10, and FIG. 11.

During operation, when the arm 94 is pivoted about the pivot rod 98 in order to move the blanket cylinder into parallel adjacency with the plate cylinder 10, the rollers 110 and 112 will roll in the cutout cam track 114 to thereby cause the plate and the attached cradle arm 60 to move through a range of orientations to facilitate lift-off of the blanket cylinder 40. As noted previously, it is important that the slight movement caused by lift-off move the blanket roll 40 away from the web or the paper, while maintaining contact with the plate roll 10. This cannot be accomplished unless the lower cradle arm 60 is in a proper orientation. This orientation can be seen from a review of FIG. 10 and FIG. 11. FIG. 10 illustrates the present invention where a large diameter blanket cylinder 40 and a large diameter plate cylinder 10 are utilized. It can be seen that the rollers 110 and 112 have caused the lower cradle arm 60 to take an orientation such that the line 120 connecting the centerline 122 for the blanket cylinder 40 to the centerline 124 for the plate cylinder 10 is within plus or minus 30° of a line 126 that straddles the opening of the cradle arm 60. In a preferred embodiment, the range of orientations between the line 120 connecting the centerlines of the blanket and the plate cylinders is within plus or minus 10° of the line 126 that straddles the opening of the bottom cradle arm 60.

Figure 11:
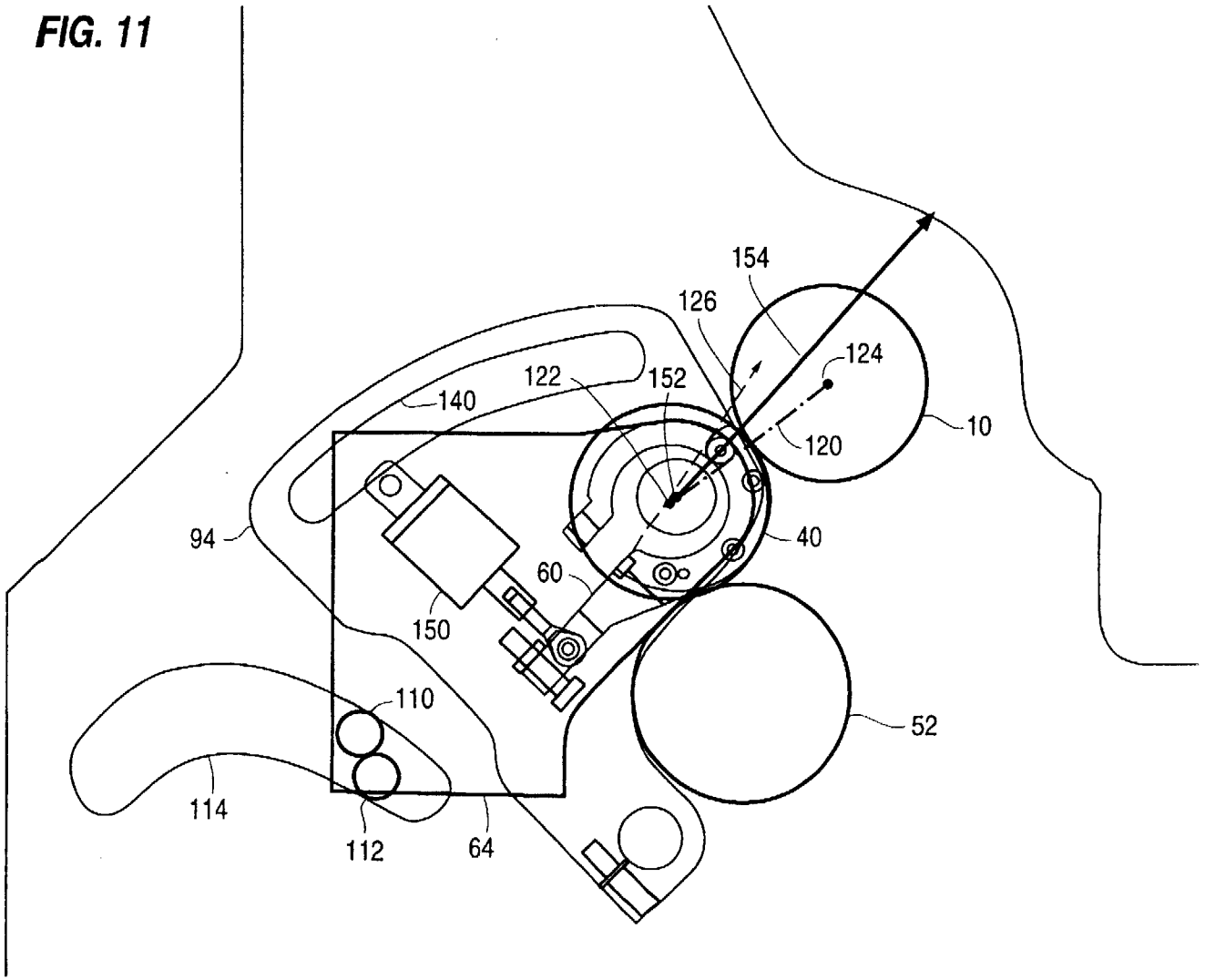
FIG. 11 is a schematic side view of the present invention with the first and second cylinders having smaller diameters relative to the diameters of the cylinders shown in FIG. 10.

Referring now to FIG. 11, there is shown a blanket cylinder 40 and a plate cylinder 10 with smaller diameters. It can be seen that the rollers 110 and 112 have moved to a different position within the track 114, but have maintained the approximate orientation of the cradle arm 60 so that the line 126 between the centerline 122 for the blanket cylinder 40 and the centerline 124 for the plate cylinder 10 is within plus or minus 30° of the line 126 that straddles the opening of the cradle arm 60. Accordingly, lift-off of the blanket cylinder 40 is facilitated for this smaller-sized diameter blanket cylinder-plate pair.

Figure 9:
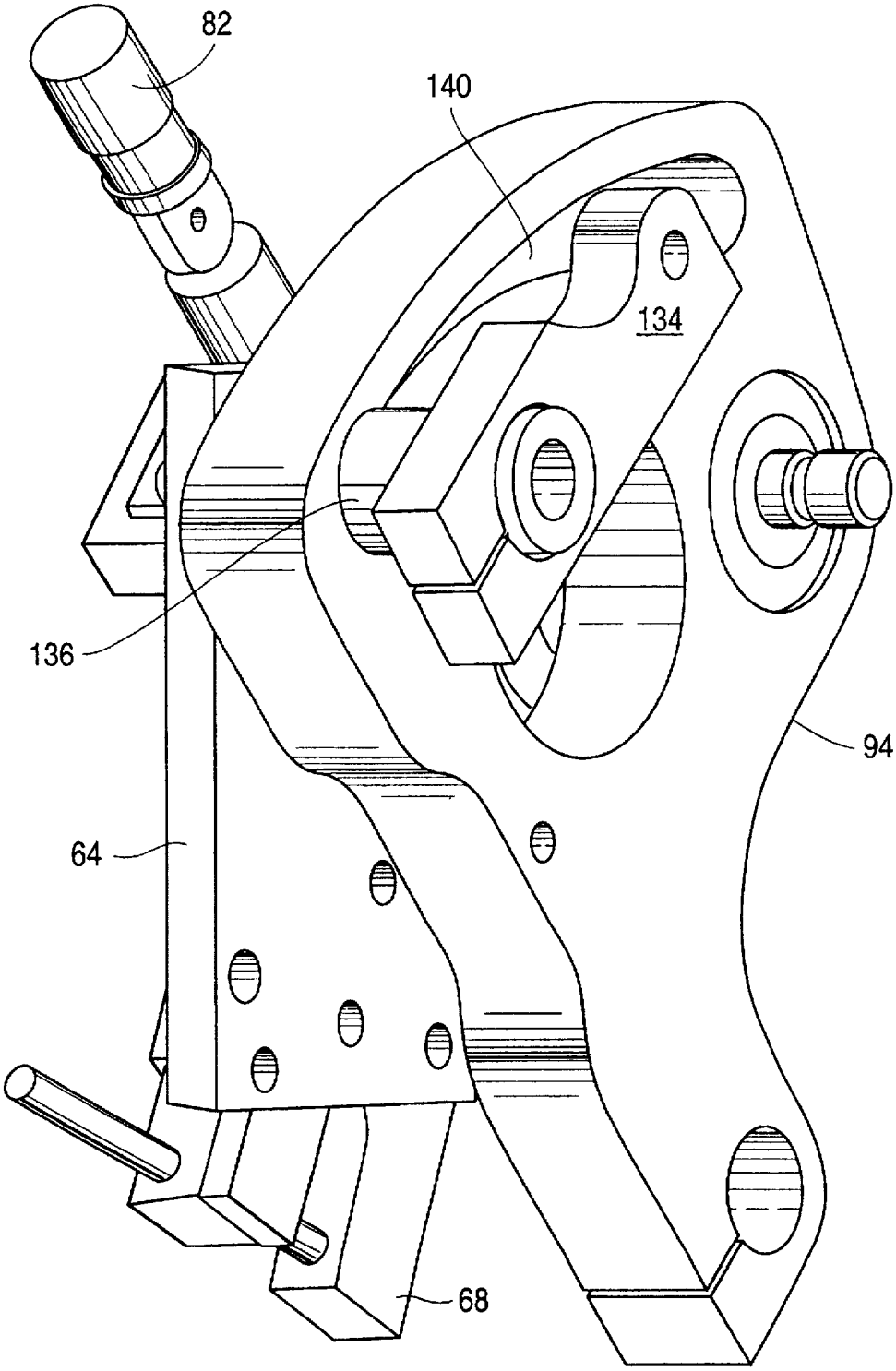
FIG. 9 is a rear perspective view showing a different perspective of the arm and the sub-plate.

Once the blanket cylinder 40 has been changed and has been appropriately positioned in parallel adjacency with the plate cylinder 10, then the cradle arm 60 must be clamped in place. There are a variety of different techniques available in the art to accomplish such a clamping operation. In the preferred embodiment shown in FIG. 6, the adjusting arm 94 is clamped into position by an air cylinder 130 that rotates and tightens a clamp nut 132 threaded onto a threaded stud 136, by means of a bell crank 134. There is a slot 140 machined into the adjusting arm 94 and the threaded stud 136 protrudes through this machined slot. The clamping mechanism comprising the threaded stud 136 and the clamp nut 132 is stationary, with the threaded stud 136 anchored to the respective frames 18 and 20. The arms 94 accordingly slide freely with the threaded stud moving within the cutout track 140 until the clamp nut 132 is clamped against the arms 94. By rotating the clamped nut 132 by means of the bell crank 130, the arm 94 is tightened against the frame 18 to thereby prevent its movement. It should be noted that the adjusting arm 94 must be clamped both before the "throw-off" or the "throw-on" of the blanket cylinder 40. Otherwise, the blanket cylinder will not lift-off impression. Note that the slot 140 is best seen in FIG. 5, and FIGS. 8–11. Likewise, the bell crank 134 is shown in FIG. 6 and FIG. 9. The threaded stud 136 is shown in FIG. 6 and FIG. 9.

Lift-off may be accomplished by a variety of different means well known in the art. In a preferred embodiment shown in the Figures, lift-off is accomplished by means of an air cylinder 150 connected to the bottom cradle arm 60 for moving that cradle arm so that it pivots about a centerline 152, which coincides with the centerline for the hub 90. It should be noted that the centerline 152 for the hub 90 is different from the centerline 122 for the blanket cylinder 40, thereby causing an eccentric movement that facilitates lift-off of the blanket cylinder 40. The fact that the centerline 152 for the hub 90 and the centerline 122 for the blanket cylinder 40 are parallel and not concentric, but rather eccentric, permits eccentric movement in a well-known manner.

Referring to FIGS. 10 and 11, it can be seen that the line 154 that connects the centerline 122 for the blanket cylinder 40 and the pivot point 152 for the hub 90 points to within plus or minus 30° of the line 120 connecting the centerlines 122 and 124 for the blanket cylinder 40 and the plate cylinder 10, respectively. In a preferred embodiment, this eccentric line 154 points to within plus or minus 10° of the line 120 connecting the centerlines 122 and 124. Note that this is an alternative method of defining the desired orientation of the cradle arms 60.

Referring again to the adjusting arm 94, in the load position, the adjusting arm 94 allows a blanket cylinder 40 to be unloaded and another to be loaded into the cradle arms 60 and 62. As the blanket cylinder 40 is loaded, it must be oriented rotationally to align the blanket gap on the blanket roll 40 with the plate gap on the plate cylinder 10. The previously noted adjustable gear 48 may be utilized to obtain perfect alignment of these gaps.

The "throw-off" and "throw-on" processes refer to the operation of lifting the cylinders from contact and putting them into contact without losing gear-tooth engagement. Gear-tooth engagement must be maintained or a rotational register will be lost. Additionally, the plate gap and blanket gaps will no longer be aligned. The purpose of the "throw-off action" is to ink the cylinders before running the web, to clean the ink from all of the cylinders before stopping the press, and to prevent damage to the cylinders. If the cylinders are left in contact with each other for an extended period of one-half hour or more, they may develop flat spots on their surfaces that will show in the printed images.

The desired sequence of steps for "throw-off" and "throw-on" is as follows:

"Throw-on" =

1) Placing the form cylinders in contact with the Anilox cylinder.

2) Placing the form cylinders in contact with the plate cylinder.

3) Placing the plate cylinder in contact with the blanket cylinder.

4) Placing the blanket cylinder in contact with the web on the impression cylinder.

"Throw-off" =

1) Removing the form cylinders from the Anilox cylinder. (Note that this is not mandatory until cleanup.)

2) Removing the form cylinders from the plate cylinder.

3) Removing the plate cylinder from the blanket cylinder.

4) Removing the blanket cylinder from the web.

Note that once the blanket cylinder is clamped and the position adjustment is accomplished by means of the hand-wheel 76, then the lift-off cylinder 150 must be placed into its "lift-on" condition. The adjusting arms 94 can now be actuated by the air cylinder 102 to bring the blanket cylinder 40 into impression with the plate cylinder 10 and the impression cylinder 52. At this point, the adjusting arms 94 may be clamped into position by the air cylinder 130 that operates to rotate the clamp nut 132 by means of the bell crank 134.

Note that the present invention permits lift-off regardless of the position of the arms 94. In particular, the present invention permits lift-off with approximately the same amount of separation, regardless of the diameter of the blanket cylinder-plate cylinder pair that is utilized. Accordingly, the present invention facilitates a design wherein the blanket cylinders may be lifted off separately from the plate cylinders, to thereby allow light-weight low-cost blanket and plate cylinders to be utilized in the industry.

The present invention permits the easy and quick substitution of various diameter blanket cylinders, as a separate unit relative to the plate cylinder. The present invention permits these cylinders to be brought into contact without significant adjustment by the press operators, while at the same time permitting lift-off over a wide range of blanket and plate cylinder diameter pairs. This is accomplished by constantly correcting/repositioning the cradle arm 60 in order to maintain the correct orientation of the blanket cylinder 40 relative to the plate cylinder 10 to permit lift-off.

It should be noted that with the present invention, light-weight and very economic blanket cylinders and plate cylinders may be utilized having a multitude of sizes from the smallest repeat length to the largest repeat length in increments of ⅛ inch or less. It is estimated that the cost for one blanket cylinder and plate cylinder pair is approximately 1/10 of the cost of a cartridge design which houses the combination of the blanket cylinder and the plate cylinder. Accordingly, a customer may purchase up to 30 sets of blanket and plate cylinder pairs for each print head for the same cost as three cartridges for each print head.

It should be noted that although the present invention has been described in the specific context of offset printing, the present invention has wide application throughout the printing industry on all known printer designs. Additionally, the present invention will be applicable whenever a lift-off type operation is required between two cylinders, whether or not they are utilized in a printing function.

Obviously, many variations of the present invention are possible in light of the above teachings. It is therefore to be understood that within the scope of the appended claims, the invention may be practiced otherwise than as specifically described.

What is claimed is:

1. A printing machine designed to accommodate different repeat lengths for a first cylinder and a second cylinder therein, comprising:

a front and rear frames;

a first cylinder cartridge, including a first cylinder with a centerline;

a first assembly attached to said front and rear frames for holding said first cylinder cartridge;

a changeable second cylinder cartridge separate from said first cylinder cartridge, said second cylinder cartridge including a second cylinder with a centerline;

a first and second cradles for holding the ends of said second cylinder cartridge, each of said cradles including a cradle arm with a arcuate surface therein; and a second assembly for each of said cradles for moving its respective cradle toward or away from said first cylinder to allow the substitution of different diameter second cylinders as said second cylinder, to be aligned in parallel adjacency with said first cylinder, said second assembly operable to change the inclination of its respective cradle arm for each different diameter second cylinder, to facilitate lift-off.

2. A machine as defined in claim 1, wherein said second assembly includes structure to change the inclination of its respective cradle arm during the movement of the cradle to bring said second cylinder in parallel adjacency with said first cylinder.

3. A machine as defined in claim 2, wherein said second assembly comprises a sub-plate on which said cradle is mounted, said sub-plate being movable through a prescribed range of inclinations so that the line connecting the centerlines for the first and second cylinders very approximately straddles the arcuate surface of said cradle arm.

4. A machine as defined in claim 2, wherein said second assembly comprises means for moving said arm of each of said cradles through a range of inclinations so that a line connecting the centerlines for the first and second cylinders is within plus or minus 30° of a line that straddles the arcuate surface of said cradle arm.

5. A machine as defined in claim 4, wherein said range of inclinations between the line connecting the centerlines of said first and second cylinders is within plus or minus 10° of the line that straddles the arcuate surface of said cradle arm.

6. A machine as defined in claim 2, wherein said second assembly comprises:

a sub-plate on which said cradle is mounted;

an oriented slot in each of said frames;

a set of rollers mounted on said sub-plate, said sub-plate being positioned so that said rollers ride in said slot, said slot being oriented so that when said sub-plate is moved, its orientation is changed as the rollers ride in said slot so that the line connecting the centerlines of said first and second cylinders is within plus or minus 30° of a line that straddles the arcuate surface of said cradle arm.

7. A machine as defined in claim 3, wherein said cradle comprises a bottom cradle arm, and a top cradle arm that may be moved to open said cradle to permit the positioning of said end of said second cylinder cartridge therein.

8. A machine as defined in claim 3, wherein said second assembly further comprises:

an adjusting arm connecting to said sub-plate; and an actuator connected to said adjusting arm and operable, when actuated, to cause said adjusting arm to move in a prescribed path to thereby cause said sub-plate to move, thereby moving said second cylinder and, at the same time, adjusting the inclination of said cradle.

9. A machine as defined in claim 8, wherein said second assembly further comprises a clamping mechanism for clamping said adjusting arm in a stationary position.

10. A machine as defined in claim 9, wherein said sub-plate in said second assembly is disposed on the interior-side of one of said frames and its respective adjusting arm is disposed on the exterior-side of said one of said frames, with said sub-plate being connected to its respective adjusting arm by means of a hub which extends through an opening in said frame.

11. A machine as defined in claim 2, wherein said first assembly includes means for laterally moving said first cylinder so that it is in line with printing plates on other first cylinders in other print stations.

12. A machine as defined in claim 2, wherein said first cylinder cartridge and said second cylinder cartridge have a fixed bearer attached at each end thereof with appropriate diameters in order to provide a precision stop for adjacent cylinders to prevent overcompression of the cylinders.

13. A machine as defined in claim 2, further comprising an adjustable gear for rotating said second cylinder, said adjustable gear being adjustable to rotate said second cylinder in order to permit alignment of a plate gap on said first cylinder to a blanket gap on said second cylinder.

14. A machine as defined in claim 2, wherein said second assembly further includes an adjustable stop for fine positioning of said cradle to thereby precisely position said second cylinder relative to an impression cylinder.

15. A machine as defined in claim 14, wherein said second assembly further includes a control structure mounted on a shaft disposed on said adjustable stop for fine positioning of said adjustable stop.

16. A machine as defined in claim 8, further comprising a shaft on which said adjusting arms pivot, said shaft extending through said front and rear frames in parallel with said first and second cylinder cartridges.

17. A machine as defined in claim 2, wherein said second assembly further comprises an actuator for causing lift-off of said second cylinder.

18. A machine as defined in claim 2, wherein said machine is an offset printing machine and said first cylinder is a plate cylinder and said second cylinder is a blanket cylinder.

19. A machine as defined in claim 2, wherein said second assembly further comprises:

a pivot assembly to pivot said cradle arms about a pivot axis which is parallel to, but different from the centerline of said second cylinder to provide eccentric movement to said second cylinder to thereby cause lift-off of said second cylinder when said pivot assembly is actuated.

20. A machine as defined in claim 19, wherein said machine is an offset printing machine and said first cylinder is a plate cylinder and said second cylinder is a blanket cylinder.

21. A machine as defined in claim 20, wherein said second assembly includes structure operable to incline its respective cradle during the movement of the second cylinder into parallel adjacency with said first cylinder so that the eccentric line, defined as a line connecting said pivot axis and the centerline of said second cylinder, points to within plus or minus 30° of the line connecting the centerline for said first and second cylinders.

22. A machine as defined in claim 21, wherein said second assembly includes structure operable to incline its respective cradle so that said eccentric line points to within plus or minus 10° of the line connecting the centerlines for said first and second cylinders.

23. A method to permit different repeat lengths for a first cylinder and a second cylinder, comprising the steps of:

placing a first cylinder cartridge which includes a first cylinder with a centerline in a first assembly;

placing ends of a second cylinder cartridge, which includes a second cylinder with a centerline, in arcuate openings in a set of first and second cradle arms so that said second cylinder is parallel to said first cylinder;

moving said cradle arms to thereby move said second cylinder in close adjacency to said first cylinder; and changing the inclination of said cradle arms for different diameter second cylinders to facilitate lift-off of said second cylinder.

24. A method as defined in claim 23, wherein said inclination changing step comprises the step of changing the inclination of the cradle arms so that a line connecting the centerlines of the first and second cylinders is within plus or minus 30° of a line that straddles the arcuate opening of the cradle arms.

25. A method as defined in claim 23, wherein said orientation inclination changing step comprises the step of changing the inclination of the cradles so that a line connecting the centerlines of the first and second cylinders is within plus or minus 10° of a line that straddles the opening of the cradle arms.

26. A method as defined in claim 23, wherein said inclination changing step comprises the step of changing the inclination of said cradle arms during siad cardle arm moving step so that the cradle arms are always properly inclined for lift-off.

27. A method as defined in claim 26, wherein said inclination changing step comprises the step of changing the inclination of the cradle arms so that a line connecting the centerlines of the first and second cylinders is within plus or minus 30° of a line that straddles the opening of the cradle arms.

28. A method as defined in claim 26, wherein said inclination changing step comprises the step of changing the inclination of the cradles so that a line connecting the centerlines of the first and second cylinders is within plus or minus 10° of a line that straddles the opening of the cradle arms.

29. A method as defined in claim 26, wherein said moving step comprises the step of pivoting an adjusting arm that is connected by way of a sub-plate to said cradle arms so that when said adjusting arm pivots, it causes said second cylinder to move, with the movement of said sub-plate operating to adjust the inclination of said cradle arms.

30. A method as defined in claim 28, further comprising the step of:

pivoting said cradle arms, upon actuation, about a pivot axis which is parallel to, but different from the centerline of said second cylinder to provide eccentric movement to said second cylinder to thereby cause liftoff of said second cylinder.

31. A method as defined in claim 29, wherein said inclination changing step comprises the step of changing the inclination of said cradle arms during said cradle arm moving step so that an eccentric line, defined as a line connecting the pivot axis and the centerline of said second cylinder points to within plus or minus 30° of the line connecting the centerlines for said first and second cylinders.

32. A method as defined in claim 30, wherein said inclination changing step comprises the step of changing the inclination so that said eccentric line points to within plus or minus 10° of the line connecting the centerlines for said first and second cylinders.

33. A printing machine designed to accommodate different repeat lengths for a plate cylinder and a blanket cylinder therein, comprising:

a front and rear frames;

a plate cylinder cartridge that includes a plate cylinder having a centerline;

a first assembly attached to said front and rear frames for holding said plate cylinder cartridge therebetween;

a blanket cylinder cartridge separates from said plate cylinder cartridge, said blanket cylinder cartridge including a blanket cylinder having a centerline;

a first and second cradle arms with an arcuate surface for holding ends of said blanket cylinder cartridge;

a second assembly for each cradle arm for moving its respective cradle arm to hold different diameter blanket cylinders in parallel adjacency with said plate cylinder, said second assembly including a sub-plate on which said cradle arm is mounted, said sub-plate being movable toward or away from said plate cylinder and also being movable through a prescribed range of inclinations to cause the line between the centerlines for the plate and blanket cylinders to be within plus or minus 30° of a line that straddles the arcuate surface of said cradle arm;

an adjusting arm connected to said sub-plate;

an actuator connected to said adjusting arm and operable, when actuated, to cause said adjusting arm to pivot about a prescribed axis to cause said sub-plate to move, thereby moving said cradle arm and said blanket cylinder held in said cradle arm, and at the same time, adjusting the orientation of said cradle arm; and, a clamping mechanism for clamping said adjusting arm in a stationary position relative to said frames when actuated.

34. A machine as defined in claim 33, wherein said sub-plate in said second assembly is disposed on the interior side of one of said frames and its respective adjusting arm is disposed on the exterior side of said one of said frames, with said sub-plate being connected to its respective adjusting arm by means of a hub which extends through an opening in said one of said frames;

wherein said frames include an oriented slot therein; and wherein said sub-plate includes a set of rollers mounted thereon, said sub-plate being positioned so that said rollers ride in said slot, said slot being oriented so that when said sub-plate is moved, its orientation is changed by cam action as said rollers ride in said slot to thereby cause the desired inclination of said cradle arm.

35. A machine as defined in claim 34, wherein said second assembly further comprises an adjustable stop for fine positioning of said cradle arm to thereby precisely position said blanket cylinder relative to an impression cylinder.

36. A machine as defined in claim 35, wherein said first and second assemblies include actuating cylinders for causing throw-off of their respective plate and blanket cylinders.

* * * * *